US006732475B1

(12) United States Patent
Lee

(10) Patent No.: US 6,732,475 B1
(45) Date of Patent: May 11, 2004

(54) USER CUSTOMIZABLE SHUTTER SYSTEM

(76) Inventor: Han-Sen Lee, 98-1, Show-Tsuo St. Show-Tsuo Village, Fu-Hsing Hsiang, Chang-Hwa Hsien (TW)

( * ) Notice: Subject to any disclaimer, the term of this patent is extended or adjusted under 35 U.S.C. 154(b) by 0 days.

(21) Appl. No.: 09/541,188

(22) Filed: Apr. 3, 2000

(51) Int. Cl.[7] ..... E06B 1/04
(52) U.S. Cl. ..... 49/505; 49/74.1
(58) Field of Search ..... 49/505, 74.1, 501; 52/473, 217, 457, 455

(56) References Cited

U.S. PATENT DOCUMENTS

| | | | | | |
|---|---|---|---|---|---|
| 96,753 | A | * | 11/1869 | Williams | 160/220 |
| 197,583 | A | | 11/1877 | Allen | |
| 1,919,702 | A | * | 7/1933 | Murphy | |
| 2,677,157 | A | | 5/1954 | Stefanakis | |
| 3,004,641 | A | * | 10/1961 | Johnson | |
| 3,455,057 | A | | 7/1969 | Baird | |
| 3,487,768 | A | | 1/1970 | Watson | |
| 4,251,966 | A | * | 2/1981 | Foltman | 52/309.1 |
| 4,655,003 | A | | 4/1987 | Henley, Sr. | |
| 4,709,506 | A | | 12/1987 | Lukaszonas | |
| 4,765,110 | A | * | 8/1988 | MacLeod | 52/473 |
| 5,020,276 | A | | 6/1991 | Zittel | |
| 5,060,442 | A | * | 10/1991 | Chubb | 52/473 |
| 5,163,260 | A | * | 11/1992 | Ricard et al. | 52/473 |
| 5,187,896 | A | | 2/1993 | Ross | |
| 5,238,042 | A | | 8/1993 | Guerrico-Escheverria | |
| 5,306,210 | A | | 4/1994 | Smit | |
| 5,347,782 | A | * | 9/1994 | Vagedes | 52/473 |
| 5,373,677 | A | * | 12/1994 | Vegedes | 52/473 |
| 5,392,561 | A | | 2/1995 | Henley, Sr. | |
| 5,548,925 | A | | 8/1996 | Marocco | |
| 5,617,688 | A | * | 4/1997 | Gandy et al. | 52/473 |
| 5,704,182 | A | * | 1/1998 | Schiedegger | 52/457 |
| 5,732,507 | A | | 3/1998 | Edwards | |
| 5,775,399 | A | | 7/1998 | Shields, Jr. | |
| 5,778,598 | A | | 7/1998 | Ohanesian | |
| 5,782,052 | A | * | 7/1998 | Lacy | 52/473 |
| 5,845,439 | A | * | 12/1998 | Hendley | 52/204.1 |
| 5,930,952 | A | * | 8/1999 | Ricci | 49/74.1 |
| 6,076,305 | A | * | 6/2000 | Hsu | 49/505 |
| 6,125,581 | A | * | 10/2000 | Grossman | 49/74.1 |
| 6,219,970 | B1 | * | 4/2001 | Liu | 49/77.1 |
| 6,219,985 | B1 | * | 4/2001 | Hsu | 52/473 |
| 6,263,632 | B1 | * | 7/2001 | Cadorette | 52/473 |
| 6,474,034 | B1 | * | 11/2002 | Dronigi | 52/473 |

* cited by examiner

*Primary Examiner*—Gregory J. Strimbu
(74) *Attorney, Agent, or Firm*—Curtis L. Harrington

(57) ABSTRACT

A user customizable adjustable shutter system employs a variety of synergistic features which may be used individually or in combination to enable a user to install a shutter set in a manner which will produce a professional finish, but without the negative aspects accompanying most custom installation processes. The system may be commercially available as a kit, or may be available as kit components which can be purchased as needed. Pre-manufactured shutter members are provided with pre drilled holes to accommodate threaded members, typically wood screws, to hold a series of decorative extensions which can be added to increase the horizontal dimension. Decorative extensions can also be inserted to increase vertical distance, if desired. A decorative extension formed to widen shutter members and as a combination middle handle and covering member may be provided to both affect the width and to eliminate the middle light gap.

13 Claims, 5 Drawing Sheets

USER CUSTOMIZABLE SHUTTER SYSTEM

FIELD OF THE INVENTION

The present invention relates to a louver and appurtenance joinder, installation and actuation system and structures to enable an average user to perform a professional installation of a shutter system and to give a finished look at least equal to that obtainable with complex installation machinery, and which will result in a less expensive, more precise installation which is less apt to result in mistake, and expensive scrappage.

BACKGROUND OF THE INVENTION

Shutters which fold over window and door openings have been in use for a significant period of time. The cost and expertise required for installation varies greatly. The ends of the configuration continuum for shutters vary significantly in terms of cost. User installations typically tend to be roughshod over-the-window-opening installations in which supports are simply bolted or screwed onto the walls in a room to both sides of a window opening. The spacing of the supports are generally dictated by the amount of space occupied by the shutter sections. As such, the supports typically are located spaced from the window opening and the result has a shoddy look and is mismatched to the opening. From within the room, the window covering protrudes out from the wall.

The "professional" installation generally requires stripping to be added to the inside of a window opening, for example. The shutter support members are further attached, with continual measurements, marking, cutting, sanding and re-painting. Where the width distance needs to be reduced, and in order to keep the shutters balanced, an amount of material must be planed from the edges of the shutters in an even fashion. Each edge which is planed must be re-sanded and re-painted with time for drying and hopefully that no additional time will be required for re-fitting.

Where an installer does not measure exactly the distance to be cut, he will either have to repeat the exercise or scrap the materials, or perhaps leave a gap at the center. The materials from which shutter systems are constructed can range from inexpensive to very expensive. At the more expensive end of the shutter spectrum, the shutters may be made from a custom laminate and ordered to exact dimensions. Typically this construction is limited to use by professional installers who have to specify all dimensions for installation exactly. In the event of an error, the shutters have to be re-ordered. Any mistakes have to be paid by the cost of extra material and time on the part of the installer which drives up the cost. Since this is known before the installation begins, the pricing is usually set to reflect the likelihood of error cost in both materials and time and is charged in advance thus driving up the cost.

The center gap continues to present a problem both in professional installations and for user installed configurations. The center light gap can be overly wide and even where it is kept to a minimum, and particularly for minimum spacing, any orientation of the shutters other than parallel will produce a noticeable wedge shaped light projection. The elimination of the light gap should be done in a way which not only provides adequate covering, but which also looks natural and blends into the overall visual theme of the shutter system.

Another problem, both from manufacturing and utilization standpoints is the physical restriction upon the simultaneous louver actuation control bar. In most lower end applications a series of "U" shaped staples which are arranged so that the "U" shaped staples have each leg located longitudinally along the centerline of the simultaneous actuation handle. The curve of each of the "U" shaped staples of the simultaneous actuation handle engage the curve of each of the "U" shaped staples of the louvers. The simultaneous actuation handle may be adjusted to adjust the angles of all of the louvers simultaneously. A groove is typically made into the frame adjacent one of the last louvers of the series in order to accommodate a tip end of the simultaneous actuation handle when the louvers are adjusted to their most closed position, when the simultaneous actuation handle is brought most closely against the louvers and frame. The staple-staple mechanical connection can produce binding forces if each connection point is not exactly oriented with the others in terms of both its angular insertion orientation and depth as well as the angular insertion orientation and depth of staples to which it is connected. The binding forces are typically not sufficient to prevent actuation, but act to begin to work the staples out of their fixation into either the louvers or into the simultaneous louver actuation control bar. When a staple is removed, it is difficult to replace, especially where the simultaneous louver actuation control bar cannot be decoupled from the louvers without pulling out the other staples. The binding forces can not only remove staples, but also cause cracks in the louvers, especially where the staples are inserted at narrow edges of the louvers.

This system also prohibits the replacement of broken simultaneous louver actuation control bars as well as replacement of defective individual louvers. Where a shutter section was custom fitted, cut and painted, a broken louver forces replacement of and therefore a repeat of the custom installation of the shutter section.

What is therefore needed is a shutter system which enables a user to perform a custom installation without the cutting, planing and painting which is involved in typical custom installations. What is further needed is a system which is forgiving and allows for fine adjustments based upon summing the contribution of relatively larger quantities but in an order which enables fine adjustment. Also needed is a system which does not require a user to make a large number minute measurements at the outset of an installation process in order to produce a professional finish. The inventive system should provide a simultaneous louver actuation control bar which does not bind or place undue forces on any of the mechanical connections with the individual louvers, and which further permits use of a wider variety of louver anchoring structures which can be placed without the destructive forces accompanying staples and the like. Finally, the needed system should enable disengagement of the simultaneous louver actuation control bar from the louvers in order to permit individual louvers to be replaced as well as for replacement of the simultaneous louver actuation control bar.

SUMMARY OF THE INVENTION

The user customizable shutter system of the invention employs a variety of synergistic features which may be used individually or in combination to enable a user to install a shutter set in a manner which will produce a professional finish, but without the negative aspects accompanying most custom installation processes. The inventive system may be commercially available as a kit, or may be available as kit components which can be purchased as needed. Premanufactured shutter members are provided with pre drilled holes to accommodate threaded members, typically wood screws, to hold a series of decorative extensions which can be added to increase or decrease the horizontal dimension. Decorative extensions can also be inserted to increase vertical distance, if desired. A decorative extension formed as a combination middle handle and covering member may be provided to eliminate the middle light gap, as well as to provide horizontal dimension. Decorative extensions are provided typically on the facing edges of the shutter sets, whereas a decorative trim is provided for either flush mounting or decorative mold mounting about a window opening.

Two new systems for attaching the simultaneous louver actuation control bar to the structures fixed into the louvers are disclosed. Both systems enable a more specialized structure to be introduced into the louvers which will produce less stress on the louvers to reduce cracking and fracture from impact force of conventional staples. The louvers can then use small eyelet screws and can also be pre-drilled. The installation can be manual where assemblers push wires from a anchoring support through an opening in the eyelets or thread a smaller anchoring support of a two anchoring support system through the eyelet and into a space on a simultaneous louver actuation control bar.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
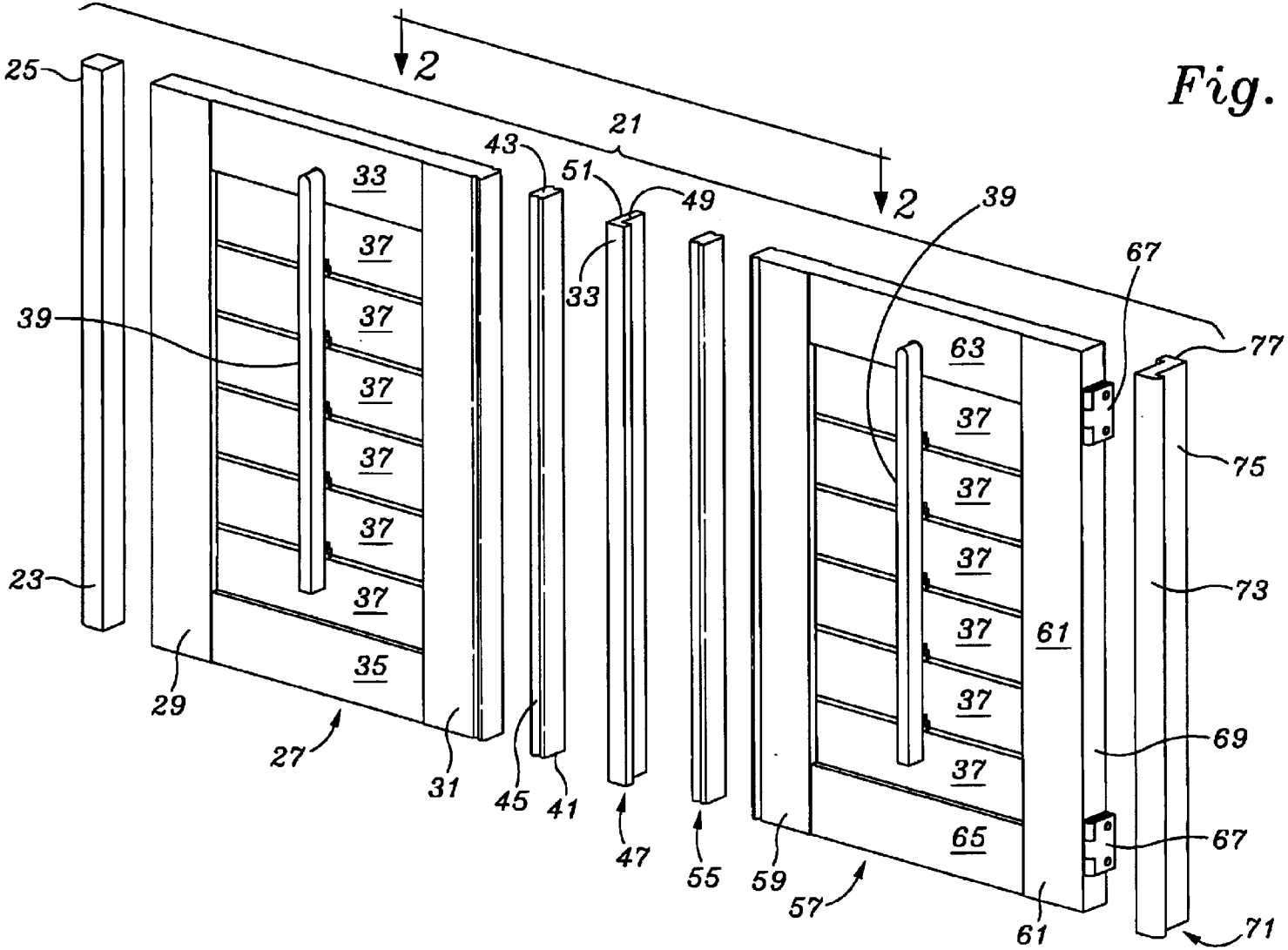
FIG. 1 is an overall perspective exploded view illustrating a shutter system in accord with the present invention and illustrating a bull nose side frame spacer, an "S" hook side frame spacer, a center covering spacer, a doublet left decorative spacer and a singlet right decorative spacer.

The description and operation of the shutter system of the invention will be best described with reference to FIG. 1 which illustrates an exploded view of a shutter system 21. Beginning at the far left side, shutter system 21 includes a bull nose window opening spacer 23. The term window opening will be used to describe the space into which the shutter system 21 will fit, even though the shutter system could fit within the portal of a room, an exterior doorway, or other opening. Generally, the term window opening will refer to any set of inwardly facing surfaces which are sufficient to mount the shutter system 21. The bull nose opening spacer 23 has a curved corner 25 to enable the spacer 23 to be partially mounted within an opening and to provide a blending of the protrusion of the shutter system 21 onto a wall or portal surface where it is necessary or desired for the shutter system 21 to protrude slightly. Reasons for a protrusion can range from shadow aesthetics to an accommodation for structure extending from a window being enclosed, such as a crank, for example.

Adjacent the spacer 23 is a first shutter panel 27. First shutter panel 27 is seen as a single solid shutter panel 27 for ease of illustration, but the space occupied by the shutter panel 27 could just as easily be occupied by a pair or more of hinged shutter panels. Because the shutter system 21 enables horizontal space adjustment at the near most meeting intersection of shutters, the presence of several pre-assembled hinged sections will not affect the performance of the shutter system 21.

The shutter panel 27 is typically made up of a first side support 29 which will be hinge connected to the opening spacer 23 and a second side support 31. The side supports 29 and 31 are connected at their top ends by a top cross support 33. The side supports 29 and 31 are also connected at their bottom ends by a bottom cross support 35. Between the top and bottom cross supports 33 and 35 and pivotally supported by the first and second side supports 29 and 31 is a series of pivotable louvers 37. Louvers 37 are typically pivotable about integrally formed pins or inserted pins which penetrate the first and second side supports 29 and 31, and which are uniformly actuated by a simultaneous louver actuation control bar 39.

Adjacent the shutter panel 27 and toward the middle area of FIG. 1, a decorative spacer 41 is seen. The cross sectional area of the decorative spacer 41 is seen at a top end 43 as having an external "figure eight" shape, in that it has a pair of gently curving portions leading into a gentle groove 45. This pattern has the effect of decoration as well as somewhat concealing the fact that it depends from the shutter panel 27 to add lateral dimension to the opening in which it is to be installed. Decorative spacer 41 conceals its presence as an independent member by depending from said second side support as a molding pattern, typically with grooves, curves, or other pattern helping it to blend in. As will be seen, the method of attachment of the decorative spacer 41 to the shutter panel 27 may vary, but in keeping with the objectives of the invention in preventing scrappage, accommodation will be made to both the second side support 31 and decorative spacer 41 to enable them to fit unitarily together in a way which will offer support, decorative blending, and in a way in which the user will not cause damage to the members as spacing members are selected. Such measures may include, by way of example only, pre-drilled and chamfered holes and apertures, or dove tail construction.

Adjacent the decorative spacer 41 is an overlapping or covering spacer 47 which generally has a "L" shape as can be seen from upper end 49 which includes a first width or side 51 which may generally correspond to a width which is typically at least greater than the width of either the decorative spacer 41 or the width of the second side support 31. A second width or side 53 extends at a generally right angle to width or side 51 and across in a direction away from second side support 31 or decorative spacer 41. The use of the overlapping or covering spacer 47 is intended to act as a spacer, may be provided in various thicknesses of the depth of the material of the first side 51, and is intended to be combined with the dimensional widths of all of the spacing elements of the system 21 in order to form the completed installation.

To the side of the overlapping or covering spacer 47 is a decorative spacer 55 which is expected to generally match the decorative spacer 41 to give a balanced overall appearance. To the right of decorative spacer 55 is a second shutter panel 57. Second shutter panel 57 is also seen as a single solid shutter panel 57 for ease of illustration, but the space occupied by the shutter panel 57 could just as easily be occupied by a pair or more of hinged shutter panels, such as a two panel by one panel opening configuration. Again, because the shutter system 21 enables horizontal space adjustment at the near most meeting intersection of shutters, the presence of several pre-assembled hinged sections will not affect the performance of the shutter system 21, and it is understood that the decorative spacers 41 and 55 can be used between adjacent first and second shutter panels 27 and 57.

The second shutter panel 57 includes the same structures as first panel 27, including first side support 59, second side support 61, top cross support 63, bottom cross support 65, and a same series of pivotable louvers 37 and a simultaneous louver actuation control bar 39.

To the right of second shutter panel 57, a pair of hinges 67 are shown as being mounted upon an outside width or surface 69, and are shown in generally closed position. It is easily seen that the decorative spacers 41 and 55 could be added between the second shutter panel 57 and that such an addition would further enhance the aesthetic balance of the system 21. For a more perfect fit, the hinges 67 may be located within a chiseled out area on surface 69. In an alternative embodiment, a spacer strip may be provided having pre-chiseled areas, in addition to any pre-chiseled area on surface 69. The fact that surface 69 has a pre-chiseled area which is covered by a the decorative spacer such as 41 and 55 will neither be noticeable nor reduce the performance of the shutter system 21 in blocking out light. One consideration will need to be either the complete separate nature of the securing mechanism for securing the hinges 67 with respect to the mechanism for securing the decorative spacers 41 and 55. One solution is to provide a series of spaced pre-drilled holes in both the surface 69 and the decorative spacers 41 and 55 which leave enough space between them to completely overlie to either side the space taken up by the hinges 67.

To the right of the hinges 67 is an opening spacer 71 which is generally angle "S" or "Z" shaped. A front portion 73 includes an outer curving transition to an edge by which the which the opening spacer 71 will form a "frame" for the system 21 into a window or wall opening. The opening spacer 71 has a central portion 75 which will have a dimension from the front portion 73 which will be generally dependent upon the width of the surface 69. A rear portion 77 extends from about even with respect to the surface 69 and in the direction of the middle of the second shutter 57. This lip helps to shut out light which would otherwise enter between the surface 69 and the surface of the central portion 75 facing the surface 69. Thus light is blocked out at least partially from the opening spacer 71, in addition to any closure between surface 69 and the surface of the central portion 75 facing the surface 69.

Figure 2:
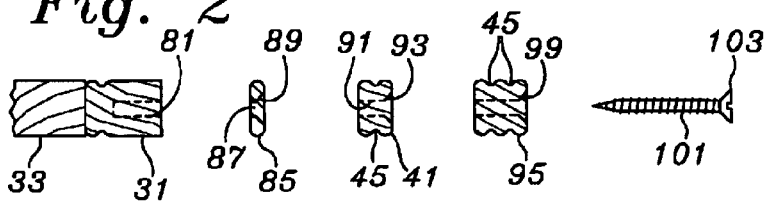
FIG. 2 is a sectional view illustrating a set of three decorative spacers adjacent a shutter structure and taken at a center of their pre-chamfered axes, and overlying a pre-drilled bore of the shutter structure, with screws preferably of a pre-specified size as a multiple of the decorative spacers provided for full insertion through the decorative spacers and into the shutter structure.

Referring to FIG. 2, a generalized view looking down along lines 2—2 of FIG. 1 is illustrated. The use of the section 2—2 is meant as an orientation to illustrate the general direction of view for FIG. 2 and subsequent Figures in order to illustrate the variations possible, as the exploded orientation of FIG. 2 includes more members than are seen in FIG. 1. The top cross support 33 is seen adjacent the second side support 31.

Second side support 31 includes a series of pre-drilled bores 81 of which one is shown in FIG. 2 and in dashed line format. Although the the decorative spacers 41 and 55 were shown as having two wave undulations, being in a general external "figure eight" shape, the spacers utilizable may vary greatly in both their external shape as well as their dimensions. In the case shown in many of the subsequent Figures, the width of the decorative spacers correspond to the number of undulations present in each spacer. This facilitates a balancing of the spacers by the user and enables the user to instantly see the relative sized thickness of the spacers.

To one side of the second side support 31 of FIG. 2 is seen a single width spacer 85 having a series of bores, one of which is seen as bore 87 and having a chamfered opening 89 to one side. Next, double width decorative spacer 41 is seen having a longer bore 91 with a chamfered opening 93. Next, a triple width decorative spacer 95 is seen having a longer bore 97 with a chamfered opening 99. A relatively long threaded member 101 is seen as having a length which is expected to generally match the combination of lengths of pre-drilled bore 81, and bores 87, 91, and 97, along with a conic head 103 shaped to match the chamfer 99. The fact that decorative spacers 85 and 41 have chamfers which will not be utilized, should not be a problem. In addition, the exterior of the decorative spacers 85, 95 and 41 include an undulating or elongate curved pattern, but need not. Although the decorative spacers 85, 95 and 41 can be plain, it is believed that a pattern which is multiples of the thickness of the spacer will function to both disguise the presence of spacers, where each begins and ends, and give a clear indication to the installer as an ordinary user, exactly what thicknesses are being utilized.

If decorative spacers 85, 95 and 41 are available, the added dimension to one side of a shutter 27 would be 1, 2, 3, 4, 5, or 6 thicknesses of spacing. Where a thickness of spacing of about three eights (3/8) of an inch is used as a benchmark for a width for the spacers 85, 95, and 41, variations in added width can be from three eights (3/8) of an inch for a single spacer 85 up to a combined thickness of two and one quarter (2¼) inches, and for a single side of a shutter system 21. Adding the contribution of both sides gives a variation of from three fourths (¾) of an inch for a pair of single spacers 85 up to a combined thickness of four and one half (4½) inches. In addition, the bull nose opening spacer 23 or the opening spacer 71 can have a width dimension contributing from about one to about three inches to further enable a combined variance in a two shutter system of an additional two to six inches. Further, the spacers 85, 95, and 41 can be added between the shutters 27 and 57. However, because of the variances possible with the combination of opening spacers 71 and bull nose version 23, as well as the spacers 85, 95, and 41, further variations in width would normally be expected to be derived by selecting a size of shutter panel 27 and 57 which is of a significant magnitude in width.

With regard to vertical height adjustment, only so much of the top and bottom cross supports 33 and 35 may be trimmed, as by cutting, as will not weaken the shutter panels 27 and 57. Additional spacing elements may be provided on the tops and bottoms of the shutter panels 27 and 57 as desired. A top and bottom spacer system would also work well with shutter panels 27 and 57 which are provided in a pre-cut discrete length which matches the lengths of the spacers 85, 95, and 41. Any top and bottom further spacers should then be cut to a length which depends in accord with the additional width provided by the spacers 85, 95, and 41.

Figure 3:
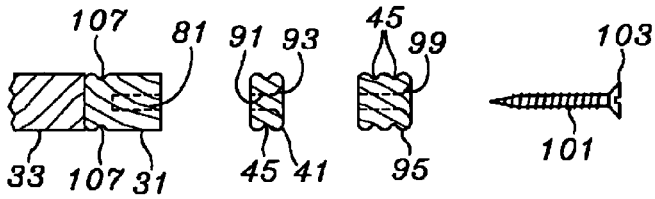
FIG. 3 is a view similar to that seen in FIG. 2, but with a doublet and triplet chamfered decorative spacer shown in relationship to a shutter.

Referring to FIG. 3, a configuration is shown in which only two decorative spacers 41 and 95 are used to add only five width magnitudes to the second side support 31. Second side support 31 is also shown as having decorative grooves 107 which define protrusions and can be used in conjunction to the grooving 45 of the decorative spacers 41 and 95 to further visually subdivide the space and provide an axially offset for the grooving for the system 21. As can be seen in comparison to the embodiment of FIG. 2, the embodiment of FIG. 3 has eliminated the decorative spacer 85 without having had a reduction in the overall length of the threaded member 101. In general, the bore 81 should be deep enough to accommodate a range of depths for a threaded member 101 and thus each set of components in the system 21 is expected to require a lesser number of quantum lengths of threaded members.

Figure 5:
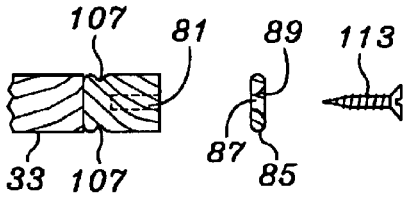
FIG. 5 illustrates a singlet chamfered spacer along side a shutter side board.
Figure 4:
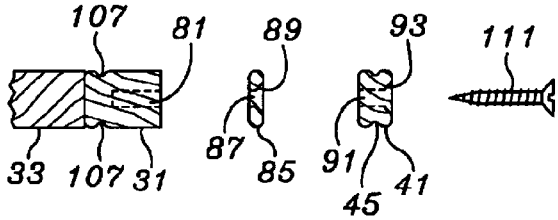
FIG. 4 is a view similar to that seen in FIGS. 2 & 3, but with a singlet and a doublet decorative spacer each having a chamfered aperture and shown in relationship to a shutter.

Referring to FIG. 4, a view of a decorative spacer 85 located just inside of a decorative spacer 41 is seen. A threaded member ill is provided as a shorter length fastener with which to secure the decorative spacers 85 and 41. Referring to FIG. 5, a single decorative spacer 85 is shown being secured by an even shorter threaded member 113. FIGS. 2–5 are illustrative of the preference for including the least narrow spacer 85 in a position adjacent the second side support 31 in order that its relative lesser structural integrity is bolstered and supported by relatively thicker decorative spacers 41 and 95. In FIG. 5, we see the decorative spacer 85 being attached to the outside of the second side support 31 when it is the only member added. Note that the bore 87 and chamfer 89 take up relatively large amounts of the sectional material at the widest point of the bore 87 and chamfer 89. In some instances, it will be preferable to provide the system 21 in a form having non-wood materials especially where the smallest decorative spacer 85 is employed. In addition, reinforcement members placed within the bore 87 and chamfer 89 may be provided such as reinforcing sleeves, or outer coverings meant to reinforce the structural integrity of the decorative spacer 85. Where the components of the system 21 are painted, a much wider latitude in material is possible.

Figure 6:
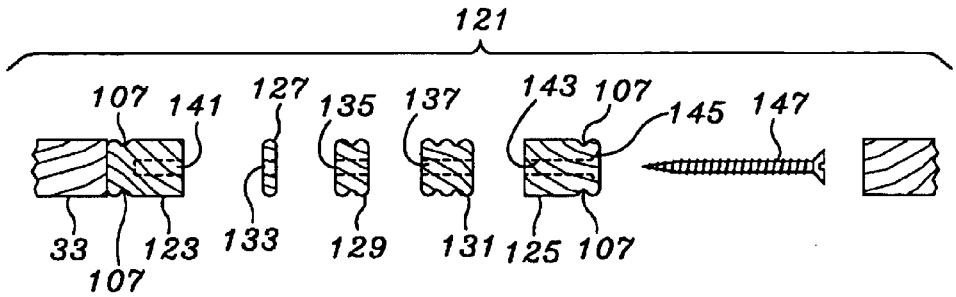
FIG. 6 illustrates a system which uses decorative spacers at a center section of a split side support.

Referring to FIG. 6, a system 121 is shown which uses decorative spacers at a center section of a split side support which includes an inner side support member 123 attached to top cross support 33, as well as an outer side support member 125 to be attached to the inner side support member 123. In this configurative embodiment, the inner and outer side support members 123 and 125 may be provided in an orientation intended for attachment to each other as an initial dimension even in the absence of decorative spacers 85, 95 and 41. In the alternative, the outer side support member 125 may be provided as a super spacer, and have a width of from about one inch to about two inches. Note that the inner and outer side support members 123 and 125 have the same decorative grooves seen for the second side support 31 as seen in FIGS. 3–5, and can be equivalent to the second side support 31 depending upon the desired width of the second side support 31. The system 121 can be used to provide a further degree of dimensional add on and do so in a manner which distributes decorative spacers to the inside of a member having the appearance of a side support.

FIG. 6 illustrates a series of decorative spacers which, for illustration purposes are shown without chamfers although the decorative spacers 85, 41 & 95 could just as easily be used. Decorative spacers 127, 129, & 131 have bores 133, 135, and 137. Inner side support member 123 has a blind bore 141 while outer side support member 125 has a through bore 143, and an outer chamfer 145. A threaded member 147 is provided which is long enough to engage the outer side support member 125 and one or more of the decorative spacers 127, 129, & 131 onto the outer side support member 125. The external appearance of the inner section having the decorative spacers 127, 129, & 131 should appear to simply have a set of centered undulations within what appears to be a single side support. Because the pattern is centered, the configuration on both sides will likely be centered. Where an amount of additional spacing is needed equivalent to one thickness, such as seen with decorative spacer 127, the use of the is an overlapping or covering spacer 47 at a closure center between two shutter sections 27 and 57 may easily be used. It is also contemplated that a second size of the overlapping or covering spacer 47 equivalent to two widths or equivalent to the width of the decorative spacer 41 be provided in order that a nonprofessional installer can always add spacers to keep the a centered aesthetic.

Further, since the decorative spacer 127 is compressed and will not typically be used in an outside position where it must be held on by chamfered contact, it is a simple matter to provide several widths of decorative spacer 127 to enable a user to finely adjust the ultimate meeting point of either two or two sets of shutters.

Figure 7:
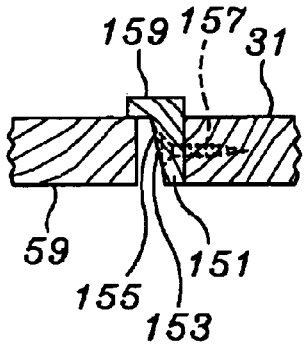
FIG. 7 illustrates a view looking from the same perspective along line 2—2 of FIG. 1, but not further illustrating the subject matter of FIG. 1 and further illustrates a covering spacer.

Referring to FIG. 7, a view looking from the same perspective along line 2—2 of FIG. 1, but not further illustrating the subject matter of FIG. 1, will illustrate one of several configurations of an overlapping or covering spacer similar to the overlapping or covering spacer 47 seen in FIG. 1. Overlapping or covering spacer 47 had a cross sectional shape of a simple "L" and is even along its length. Therefore, additional covering spacers which are also preferably even along their length will also be shown from an end view perspective and attached directly onto the side support members 31 and 59. Further, for simplicity, the presence of spacers such as decorative spacers 41 and 55 are eliminated, although the covering spacers could be easily mounted atop such decorative spacers 41 and 55, as well as onto the outer side support members 125.

FIG. 7 illustrates a covering spacer 151 which is an angled "L" having a slanted surface 153 having a chamfer 155 which accommodates a threaded member 157 shown in phantom. A surface 159 is normally exposed as a main portion of a central covering rib and is raised slightly from the surfaces of side support members 31 and 59. The exposed surface of side support member 59 is overlapped slightly by the shorter dimension of the "L" shape which supports surface 159. The gap between the surface of side support member 59 facing slanted surface 153 is substantial only to illustrate that light coverage may be accomplished even though a significant space remains between the two support members 59 and 31. The slanted surface 153 is generally exaggerated in order that it be visually perceptible. Slanted surface 153 is provided to accommodate the possibility of a swinging arc travel of the support member 31. Where a single shutter member 27 is narrow and works independently, it will produce a more abrupt arc. So that there is no interference between the innermost edge of the covering spacer 151 and the outer edge of the support member 59 as the support member 31 swings past. Typically shutter installations include some other mechanism for holding the shutters closed, and in two shutter sets an interference fit is sometimes had for urging the members shut, but this is not preferred. The slanted surface 157 enables the clearance between the support members 31 and 59 to be very close without having an interference.

Figure 8:
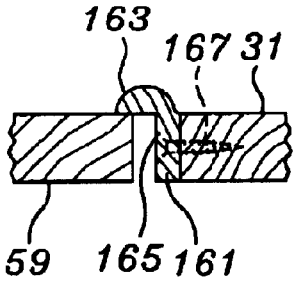
FIG. 8 illustrates a covering spacer in which the covering member is curved.

FIG. 8 illustrates a covering spacer 161 in which the covering member is curved in order to form a center decorative piece having a curved surface 163 having a chamfer 165 which accommodates a threaded member 167 shown in phantom. Again, the gap between the support members 31 and 59 is exaggerated, and the covering spacer 161 may have a slanted or curved surface similar to that of covering spacer 151 in order to provide clearance for opening and closing.

Figure 9:
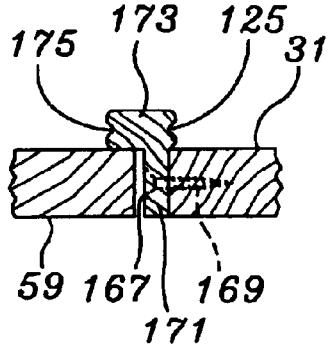
FIG. 9 illustrates a covering spacer in which the covering member is extended outwardly from the surfaces of the support members to form a handle projection.

FIG. 9 illustrates a covering spacer 171 in which the covering member is extended outwardly from the surfaces of the support members 31 and 59 in order to form a handle projection 173, and in which the sides of the handle projection 173 have sides 175 which are both curved and grooved in a manner which is similar to the curves and grooves seen in the decorative spacers 41 and 95 of FIG. 2, in order to provide a matching effect. A chamfer 167 accommodates a threaded member 169 shown in phantom. Again, the gap between the support members 31 and 59 is exaggerated, and the covering spacer 171 may have a slanted or curved surface similar to that of covering spacer 151 in order to provide clearance for opening and closing.

Figure 10:
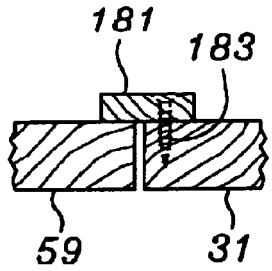
FIG. 10 illustrates a flat covering spacer in which the covering member only overlies the surfaces of the support members.

FIG. 10 illustrates a flat covering spacer 181 in which the covering member only overlies the surfaces of the support members 31 and 59 and in which a threaded member 183 extends through one side of the flat covering spacer 181 and into one of the support members 31 and 59, and in this case seen to enter the front side of support member 31.

Figure 11:
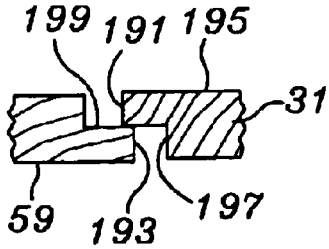
FIG. 11 illustrates a pair of opposing support members having overlapping ends.

FIG. 11 illustrates a pair of opposing support members 31 and 59 having overlapping ends 191 and 193. The fact that the overlapping ends 191 and 193 are symmetrical or completely complementary is not required. For example, considering surface 195 to be the front of the shutter system 21, the depth of an accommodating rear surface 197 could be increased to accommodate a longer end 193. A visual amount of the side 199 of end member 193 seen as a gap would ultimately depend upon how closely the decorative spacers, such as spacers 127, 129, and 131 could be selected.

Figure 12:
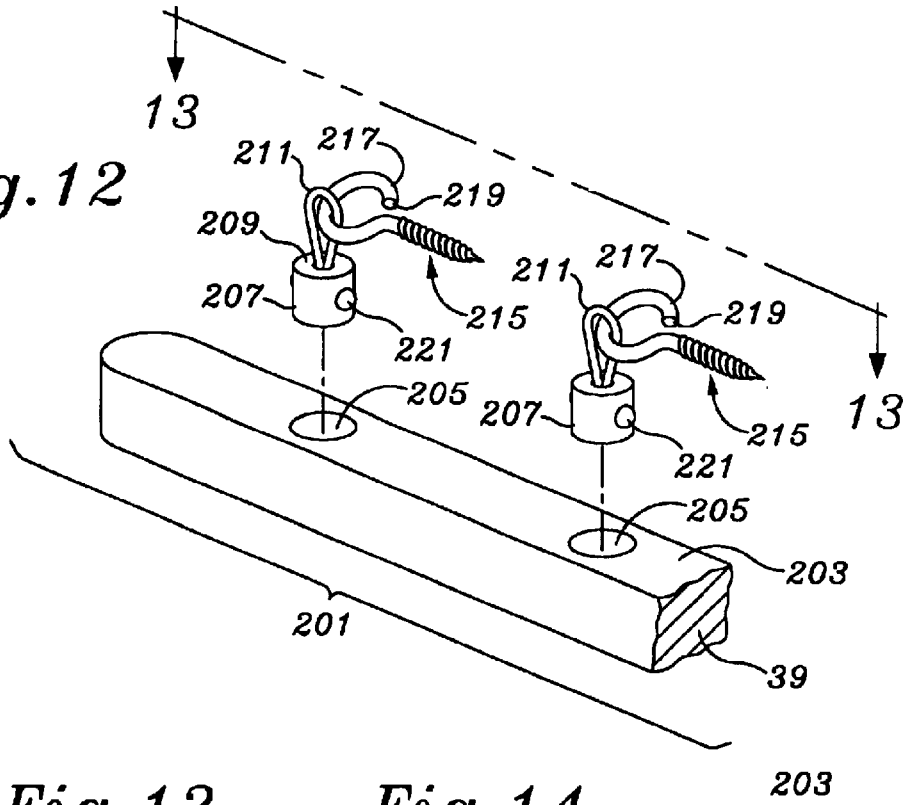
FIG. 12 illustrates a simultaneous louver actuation control bar attachment system.

Referring to FIG. 12, an advantageous simultaneous louver actuation control bar attachment system 201 is illustrated. Rather than using hard structure such as staples which are not precisely inserted and certainly not precisely held, especially due to variations in material, a softer approach is utilized which provides (1) more holding area, (2) a more flexible operation, and (3) the ability to remove the simultaneous louver actuation control bar 39.

The simultaneous louver actuation control bar 39 seen in FIG. 1 is again shown, but illustrated apart from the louvers 37 so that its rear surface 203 can be seen. A series of bores 205 are provided having a diameter which may range as high as their depth. An anchor anchoring support 207 is provided preferably as a plastic member having an upper surface 209 from which a flexible loop 211 extends. In practice, the anchoring support 207 could be made from injection molded plastic which is molded about a braided wire. In the alternative, the flexible loop could be made of nylon.

The use of a flexible loop 211 enables the insertable placement of the anchoring supports 207 within the simultaneous louver actuation control bar 39 while it is positioned against a flat surface, much like the orientation seen in FIG. 12. Machine insertion placement is therefore enabled. The flexible loops 211 are seen engaging loop screws 215 having open eye portions 217 due to an opening 219 which is large enough that the flexible loop 211 can be inserted through it to form the orientation seen in FIG. 12. The loop screws 215 are shown only for orientation purposes as in assembly, the very small loop screws 215 will be inserted into individual louvers 37, probably at a time before the louvers 37 are introduced into the shutter panel 27, which will further reduce scrappage. By insuring that the loop screws 215 are more carefully inserted into the louvers 37 individually, and tested, the failure of component parts of a shutter set can be avoided. When such a failure does occur at the louver assembly operation point, the individual louver can be discarded before it is incorporated into the shutter panel 27.

The anchoring supports 207 may be held into the bores 205 with glue or other holding material. In addition, the outer surface of the anchoring supports can have interference structures which are designed to engage and hold them within the apertures 205. One such structure seen in FIG. 12 is a spherical surface section projection 221 which will, depending upon the materials chosen, deform upon entry into the bores 205. Other structures are possible, such as load flanking structure, but it may be desirable, again based upon materials chosen for the anchoring support 207 and the flexible loops 211 to enable the user to have the ability to remove and replace a anchoring support 207 should it break or should the loop 211 break. In this case, removability should be weighed against the use of more permanent insertion placement methods.

Figure 13:
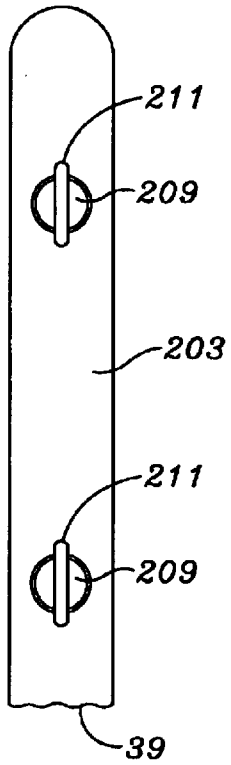
FIG. 13 illustrates a view taken along line 13—13 of FIG. 12.

Referring to FIG. 13, a view taken along line 13—13 of FIG. 12 shows the upper surface 209 of the anchoring supports 207 and the flexible loops 211. The orientation of the loops 211 is not believed to be important, and in some cases where the loops 211 emerge from a common hole of the surface 209 of the anchoring support 207, a twisting effect may occur and the orientation of the loops 211 may be undiscernible. Where the anchoring supports 207 are injection molded, the loops 211 may be made to emerge from a pair of openings to thus control the orientation of the loop 211. Further, the length of the loop 211 can be varied in conjunction with the size of the eye portions 217 to control the distance between the louvers 37 and the simultaneous louver actuation control bar 39. The space therebetween can be more tightly controlled due to the flexibility of the loop 211. The flexibility of the loop 211 enables the loops 211 to be manually inserted into the eye portions 217. A hook instrument with a split end can be used for quick attachment.

Figure 14:
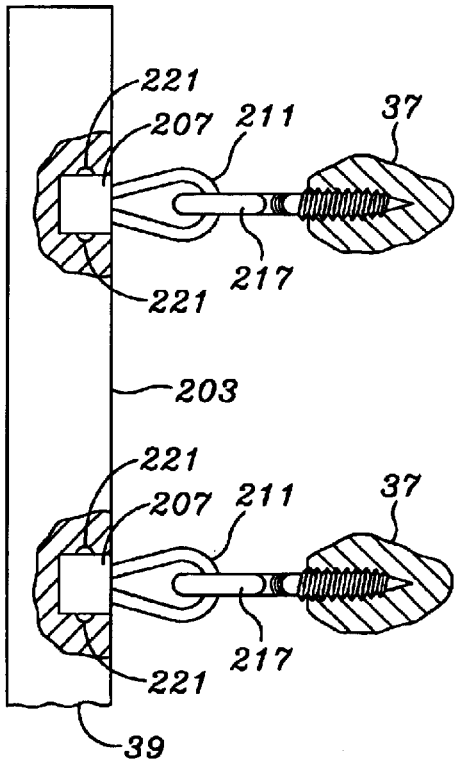
FIG. 14 illustrates a side semi sectional view of the simultaneous louver actuation control bar.

Referring to FIG. 14, a side semi sectional view of the simultaneous louver actuation control bar 39 with anchoring supports 207 inserted and in relationship to loop screws 215 within louvers 37 is seen. The orientation will again depend upon the desired shape and size of the members. The loop screws 215 could be oriented one quarter turn differently from the orientation seen in FIG. 14, particularly where different materials for the loop 211 are chosen. One material chosen for loop 211 could be compressible to enable it to be forced through the opening 219 such that it could be removed from the opening 219 only by specifically directed force.

Figure 15:
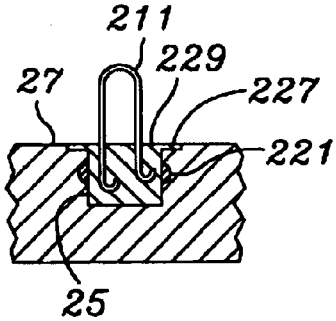
FIG. 15 illustrates an alternative embodiment of the anchoring support having a flange.

Referring to FIG. 15 an alternative embodiment of the anchoring support 207 is seen as a anchoring support 225 having a flange 227 which may be either thin enough to enable the anchoring support 225 to work in conjunction with the bores 205 without chamfering, or thick enough that a chamfer would be required. An expanded contact surface such as flange 227 can be utilized additional surface area contact to further enhance glued holding structures. Also, the loop 211 is seen emerging from two separate points on a surface 229 of the anchoring support 225.

Figure 16:
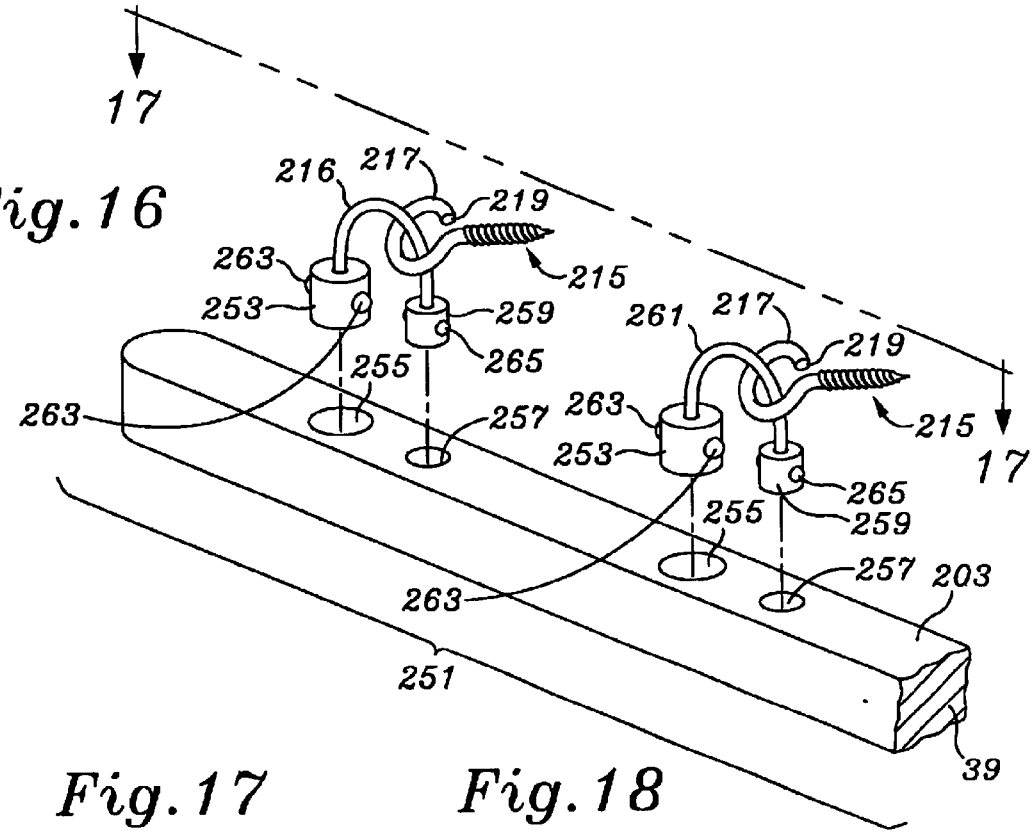
FIG. 16 illustrates a two-anchoring support system.

Referring to FIG. 16, a two-anchoring support system 251 is seen in which a first larger anchoring support 253 is preferably machine inserted upon the simultaneous louver actuation control bar 39, and into a relatively larger bore 255. Adjacent the relatively larger bore 255 is a relatively smaller bore 257 into which a smaller anchoring support 259 will be inserted. The anchoring supports 253 and 259 are joined by a flexible connection member 261 which may be made of the same material as loop of material 211. Ideally, the anchoring supports 253 and 259 are manufactured together and possibly by injection molding with the anchoring supports 253 and 259 in adjacent molds. A set of spherical surface section projections 263 and 265 on the anchoring supports 253 and 259 may be similar to the spherical surface section projection 221 seen earlier for anchoring support 207, but are expected to have a size befitting the size of the anchoring supports 253 and 259 as well as are proper for the materials of construction. Generally, softer materials will enable the use of spherical surface section projections 263 and 265.

Several objectives may be obtained with the size differential between the anchoring supports 253 and 259. First, it may lend an additional degree of mechanical orientation for engagement with the orientation of the eye portions 217 of the loop screws 215. Second, and along with the aforementioned mechanical discipline, and especially where the flexible connection member 261 is short, it provides an additional method for discipline in both manufacturing and assembly. In manufacturing, the differential size of the anchoring supports 253 and 259 facilitate the loading of the anchoring support 253 and 259 assembly onto an automated machine for machine insertion of anchoring support 253 into simultaneous louver actuation control bar 39. Storage and shipping of the machine loaded simultaneous louver actuation control bar 39 is further facilitated since it can be shipped as one unit without having to count and supply loose parts in a separate packaging. The use of a relatively smaller anchoring support 259 enables it to be threaded directly through the main circular opening of eye portions 217 of the loop screws 215. As a result, the assembler of the shutter panel 27 does not have to try to work the connection member 261 through the opening 219 of the eye portion 217. Where the materials would have otherwise permitted damage to be inflicted by the assembler, such as where the material of the connection member 261 could be damaged by forcing it through a small opening 219 of the eye portion 217. Further, it permits a loop screw 215 to be used which has no opening 219.

Third, in the event that stress is placed on the connecting member 261, rather than break, the anchoring support 259 may be set to simply dislodge from the bore 257. Such pre-set force limit dislodgement also indicates a fourth factor, that of enabling the system 251 to be selectively disengaged by enabling the anchoring supports 259 to be disengaged form the bore 257. With this configuration, the user can disengage the simultaneous louver actuation control bar 39 to facilitate cleaning of the louvers 37 as well as to facilitate repair of a damaged louver 37, etc.

Figure 17:
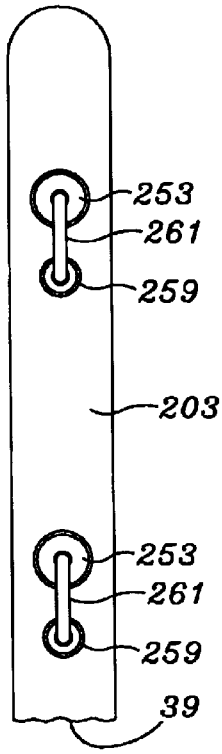
FIG. 17 illustrates a view taken along line 17—17 of FIG. 16.

Referring to FIG. 17 a view taken along line 17—17 of FIG. 16 shows the anchoring supports 253 & 259 in their respective bores 255 & 257, and the relative orientation and discipline given to the connecting member 261 whose length can be varied to vary the looseness with which the simultaneous louver actuation control bar 39 interacts with the louvers 37.

Figure 18:
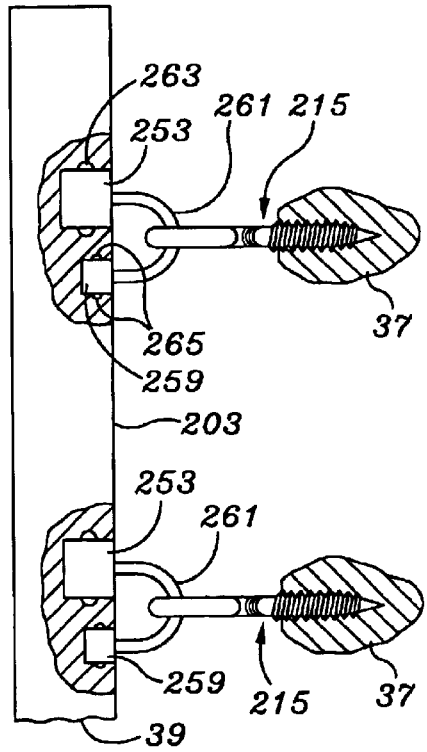
FIG. 18 illustrates a side semi-sectional view of the simultaneous louver actuation control bar.

Referring to FIG. 18, a side semi sectional view of the simultaneous louver actuation control bar 39 with anchoring supports 253 & 259 inserted and in relationship to loop screws 215 within louvers 37 is seen. The orientation is seen to be more dependent upon two anchoring support orientation, and the orientation of the loop screws 215 will generally be dependent upon the general orientation of the connecting members 261 along the simultaneous louver actuation control bar 39.

While the present invention has been described in terms of a system for custom installation of a shutter set by non-professionals and in which the ultimate inside dimensions can be pre-selected, one skilled in the art will realize that the structure and techniques of the present invention can be applied to many structures, including any structure where decorative spacer elements may be added for ensuring a proper fit.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. An adjustable shutter system comprising:

a first shutter set having a frame including a first side support having a first height and a first depth, said frame being adapted for connection to at least one of a hinge and another frame, said first shutter set further including a second side support and a plurality of louvers disposed between said first and second side supports;

a decorative spacer having a second depth substantially equal with said first depth and a second height substantially equal with said first height; said decorative spacer selectably attached to said first side support of said first shutter set for adding width to said first shutter set, said decorative spacer and said first side support each including at least one rounded vertically extending protrusion having a generally semi-circular shape in cross section projecting away from said shutter system in a direction generally perpendicular to said width of said first shutter set and extending a length substantially equal to one of said first and second heights for visually camouflaging the separate attachment of said decorative spacer, each said rounded vertically extending protrusion comprising a continuous whole with a respective one of said decorative spacer and said first side support.

2. The adjustable shutter system as recited in claim 1 and wherein said first side support of said first shutter set includes a first plurality of pre-drilled bores having blind ends, and wherein said decorative spacer has a second plurality of pre-drilled bores aligning with said first plurality of pre-drilled bores and wherein said decorative spacer is held in place by a first plurality of threaded members engaging said bores.

3. The adjustable shutter system as recited in claim 1 and further comprising a second shutter set having a second frame including a third side support having a third height and a third depth, said second shutter set for mounting opposite said first shutter set and including a fourth side support.

4. The adjustable shutter system as recited in claim 3 wherein said second shutter set third side support includes a first plurality of pre-drilled bores having blind ends, and further comprising:

a second decorative spacer having a fourth depth substantially equal with said third depth and a fourth height substantially equal with said third height, and having a second plurality of pre-drilled bores;

a plurality of threaded members, each of said plurality of threaded members extending through an associated one of said second plurality of bores of said second decorative spacer and an associated one of said first plurality of pre-drilled bores and stopping before said blind end of said associated one of said first plurality of pre-drilled bores, said second decorative spacer selectively attached to said third side support by said second plurality of threaded members for adding width to said second shutter, said second decorative spacer including at least one vertical extending protrusion for camouflaging the attachment of said second decorative spacer with said third side support.

5. The adjustable shutter system as recited in claim 1 and further comprising a window spacer adjacent said first shutter set.

6. The adjustable shutter system as recited in claim 1 and wherein said first side support of said first shutter set includes a plurality of pre-drilled bores and wherein said decorative spacer includes a plurality of apertures, each of said plurality of apertures of said decorative spacer spaced for alignment with each of said plurality of pre-drilled bores; and a plurality of threaded members, each of said threaded members when extending through a respective one of said apertures of said decorative spacer and a respective one of said pre-drilled bores stops before a blind end of said respective one of said pre-drilled bores.

7. The adjustable shutter system as recited in claim 6 and wherein said decorative spacer apertures are each chamfered.

8. An adjustable shutter system comprising:

a first shutter set having a frame including a first side support having a first height and a first depth, said frame being adapted for connection to at least one of a hinge and another frame, said first shutter set further including a second side support and a plurality of louvers disposed between said first and second side supports;

a decorative spacer having a second depth substantially equal with said first depth and a second height substantially equal with said first height; said decorative spacer selectably attached to said first side support of said first shutter set for adding width to said first shutter set, said decorative spacer and said first side support each including at least two vertically extending protrusions having a same shape in cross section projecting away from said shutter system in a direction generally perpendicular to said width of said first shutter set and extending a length substantially equal to one of said first and second heights for visually camouflaging the separate attachment of said decorative spacer, each said rounded vertically extending protrusion comprising a continuous whole with a respective one of said decorative spacer and said first side support.

9. The adjustable shutter system as recited in claim 8 and wherein said first side support of said first shutter set includes a first plurality of pre-drilled bores having blind ends, and wherein said decorative spacer has a second plurality of pre-drilled bores aligning with said first plurality of pre-drilled bores and wherein said decorative spacer is held in place by a first plurality of threaded members engaging said bores.

10. The adjustable shutter system as recited in claim 8 and further comprising a second shutter set having a frame including a third side support having a third height and a third depth, said second shutter set for mounting opposite said first shutter set and including a fourth side support.

11. The adjustable shutter system as recited in claim 10 wherein said second shutter set third side support includes a first plurality of pre-drilled bores having blind ends, and further comprising:

a second decorative spacer having a fourth depth substantially equal with said third depth and a fourth height substantially equal with said third height, and having a second plurality of pre-drilled bores;

a plurality of threaded members, each of said plurality of threaded members extending through an associated one of said second plurality of bores of said second decorative spacer and an associated one of said first plurality of pre-drilled bores and stopping before said blind end of said associated one of said first plurality of pre-drilled bores, said second decorative spacer selectively attached to said third side support by said second plurality of threaded members for adding width to said second shutter set, said second decorative spacer including at least one vertical extending protrusion for camouflaging the attachment of said second decorative spacer with said third side support.

12. The adjustable shutter system as recited in claim 11 and wherein said second plurality of bores are each chamfered.

13. The adjustable shutter system as recited in claim 8 and further comprising a window spacer adjacent said first shutter set.

* * * * *